United States Patent [19]

Michael

[11] 4,209,034

[45] * Jun. 24, 1980

[54] BACKWATER TANK FOR A BUILDING CONNECTED TO A VACUUM DRAIN FACILITY

[75] Inventor: Harald Michael, Hamburg, Fed. Rep. of Germany

[73] Assignee: Electrolex GmbH, Hamburg, Fed. Rep. of Germany

[ * ] Notice: The portion of the term of this patent subsequent to Oct. 17, 1995, has been disclaimed.

[21] Appl. No.: 940,301

[22] Filed: Sep. 6, 1978

[30] Foreign Application Priority Data

Mar. 4, 1978 [DE] Fed. Rep. of Germany ..... 2809431

[51] Int. Cl.[2] ..... E03D 1/00

[52] U.S. Cl. ..... 137/236 R; 137/255; 137/205; 4/300; 4/431; 4/198

[58] Field of Search ..... 137/205, 236, 363, 376; 4/300, 431, 198

[56] References Cited

U.S. PATENT DOCUMENTS

| | | | |
|---|---|---|---|
| 3,461,803 | 8/1969 | Stothoff | 137/363 X |
| 3,584,640 | 6/1971 | Chapman | 137/376 |
| 4,120,312 | 10/1978 | Michael | 137/236 R |

*Primary Examiner*—Alan Cohan

*Attorney, Agent, or Firm*—Larson, Taylor and Hinds

[57] ABSTRACT

A backwater tank system is provided for a building connected to a vacuum drain facility wherein the waste water of the building is drained off by gravity feed lines into a collector which is connected to a vacuum drain conduit by means of a pneumatically controlled check valve that opens automatically at a specific maximum water level, and wherein a ventilated backwater tank is connected to the gravity conduit or the collector at a level above the maximum water level in the collector, the capacity of the backwater tank being large as compared with that of the collector. The check valve and the pneumatic control devices therefor are disposed in or on the tank outside the main chamber thereof and preferably in an auxiliary chamber in the tank. The tank, check valve and control device form an integrated pre-assembled unit which includes an inlet connection adapted to be connected to the gravity feed line.

10 Claims, 4 Drawing Figures

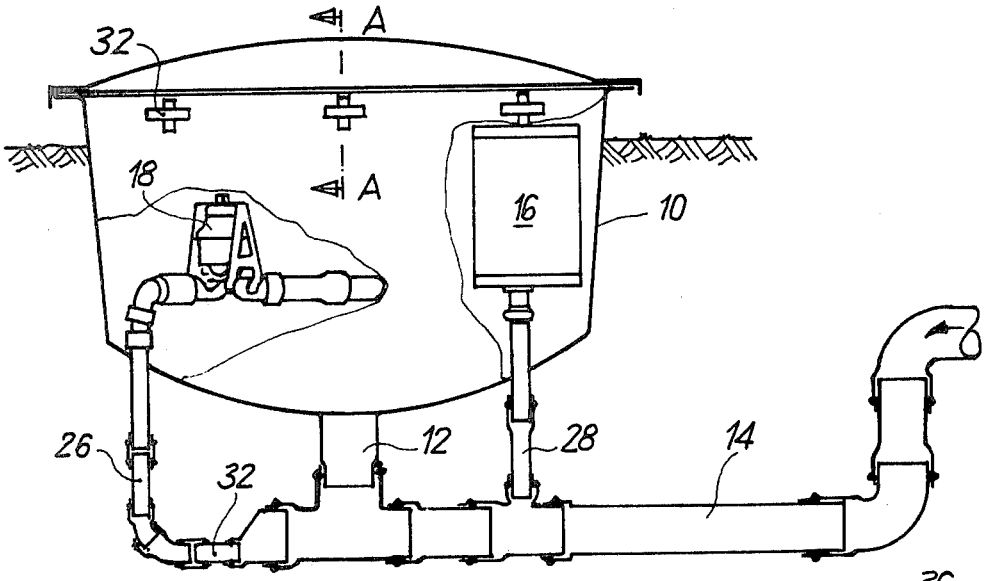
Fig. 1
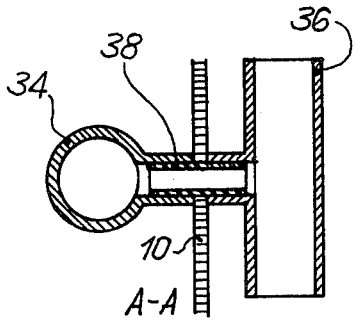
Fig. 3
Fig. 2
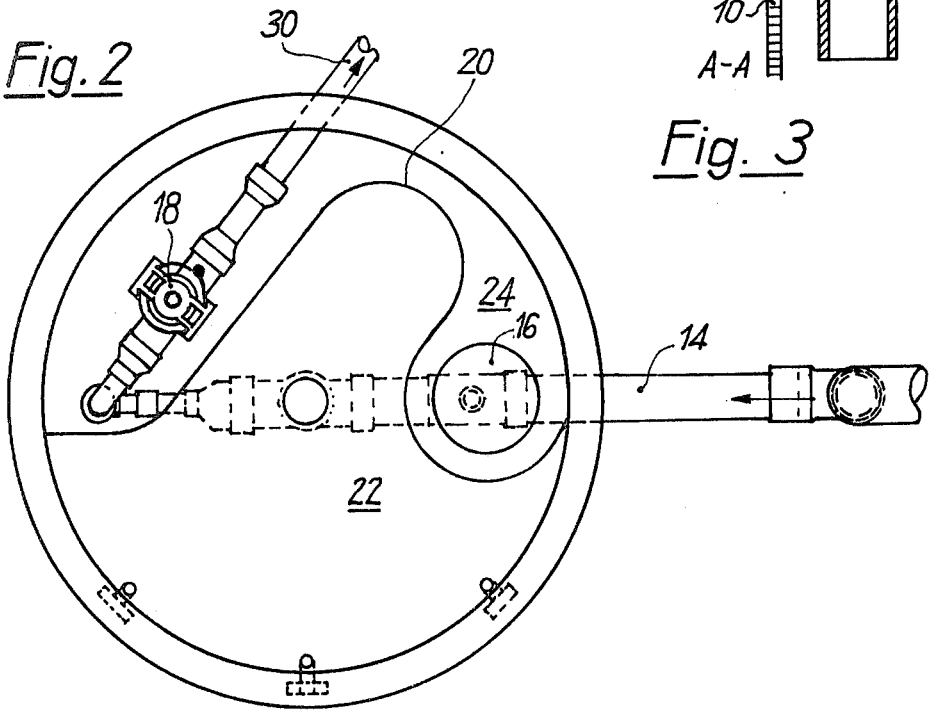

BACKWATER TANK FOR A BUILDING CONNECTED TO A VACUUM DRAIN FACILITY

FIELD OF THE INVENTION

The invention relates to an improved vacuum-type waste water removal system.

BACKGROUND OF THE INVENTION

The invention here is concerned with a backwater tank for a building connected to a vacuum drain facility, whose waste water is fed through gravity feed lines or conduits to a collector which is connected to a vacuum drainage conduit through a valve that opens automatically at a specific maximum water level. Moreover, the invention is particularly concerned with a waste water removal system such as disclosed in German Pat. No. 2,653,713, which corresponds to copending U.S. Application Ser. No. 855,086, filed on Nov. 28, 1977 now U.S. Pat. No. 4,120,312. In this patent, a connection is provided to a ventilated backwater tank. The volume of the tank is large in comparison to the gravity conduit or the said collector and the connection is provided at a level above the maximum water level in the collector.

Various embodiments of the backwater tank are described in the patent. However, in each instance, relatively complex, and hence expensive, installation operations are required, generally because the backwater tank, the check valve and the control device thereof have to be installed separately. Moreover, if the control device and the check valve were to be installed in a covered shaft separately from the backwater tank, there is the danger that in winter, this shaft could be so tightly compacted or sealed by ice and snow that a vacuum could be established from a lack of sealing of the valve of the vacuum-operated control device, so as to result in malfunctioning of the control device. It is also noted that prior art backwater tanks and control shafts for the check valve and the control device are characteristically located relatively deep in the ground and are relatively heavy, so that dredges or the like must be utilized for excavation work. In places where access is difficult, this leads to further complications.

SUMMARY OF THE INVENTION

In accordance with the invention, an arrangement is provided which permits substantial pre-assembly of the system described above, with all the attendant advantages, and to this end, it is provided, according to the invention, that the check valve and/or the pneumatic control device be disposed in or on the backwater tank, outside the main chamber thereof. This arrangement enables the backwater tank, the check valve and the control device therefor, to be delivered to the building site as a compact structural unit, with only two external pipe connections. Thus the work to be done at the site is substantially simplified, and risk of errors in installation are largely ruled out.

In a preferred, practical embodiment of the invention, the check valve and the pneumatic control device therefor are disposed in a common ancillary chamber in the backwater tank. In this location, protection is afforded by the cover of the backwater shaft. In addition, the valve and control device are readily accessible from above. Moreover, a vacuum in the ancillary chamber can be reliably prevented by providing a constantly open connection between the main chamber and the ancillary chamber of the backwater tank, e.g. by providing a gap between the upper edge of a partition separating these two chambers and a cover of the backwater tank.

Advantageously, the backwater tank is located in the ground outside the house or building in which the waste water system is located. In this way, installation in the house or building, and the destruction attendant thereto, are avoided. Further, the need is eliminated for a second shaft such as was heretofore necessary to receive the check valve and the control box. The excavation necessary for the backwater tank is relatively insignificant, and this can be done manually, when, as provided in a preferred embodiment, the connections to be joined to the gravity feed line of the house are taken out toward the bottom from the backwater tank so that a very flat structure results. In fact, in a preferred embodiment where the unit is made of plastic, a single man can carry the whole unit.

Other features and advantages of the invention will be set forth in, or apparent from, a detailed description of the preferred embodiments found hereinbelow.

BRIEF DESCRIPTION OF THE DRAWINGS

FIG. 1 is a side elevational view, partly in section, of a backwater tank according to the invention;

FIG. 2 is a top view of the tank according to FIG. 1, with the cover removed;

FIG. 3 is a section taken generally along line A—A of FIG. 1; and

DESCRIPTION OF THE PREFERRED EMBODIMENTS

Figure 4:
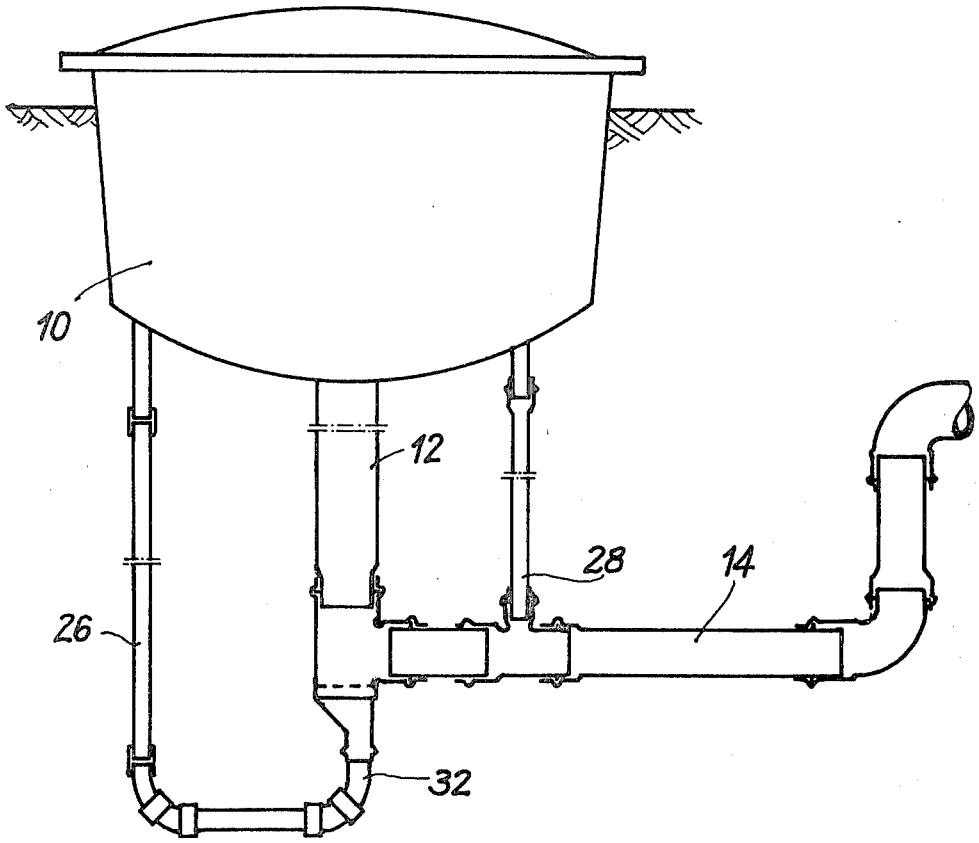
FIG. 4 is a view similar to that of FIG. 1 of a further embodiment of the pipe connections to the backwater tank.

Referring to FIGS. 1 and 2, a first embodiment of the invention is shown. The system basically comprises a backwater tank 10 which is connected to a gravity feed line or conduit 14 via a connection 12. Waste water from a building collects in the gravity conduit 14 in amounts, for example, of 8 to 40 liters before a check valve 18, responsive to a pneumatic signal from a control device 16 that measures the water level in conduit 14, provides connection of gravity conduit 14 to a vacuum drainage conduit. Advantageously, the check valve 18 remains open after suction of the waste water from gravity conduit 14 for a period long enough that the volume of air flowing thereafter through check valve 18 will be two to fifteen times, and advantageously, eight to twelve times, the volume of the water. The construction and operation of control device 16, and check valve 18 connected thereto, are conventional and utilize conventional control conduits (not shown) in a well-known manner. Hence, a description of this aspect of the system, which forms no part of the present invention, will be dispensed with.

In the exemplary embodiment illustrated, the lower part of gravity conduit 14 serves as a collector for waste water that is to be proportionally suctioned off in the small amounts indicated above. It is obvious that the lower part of gravity conduit 14 can be supplemented with the provision of a special collector (not shown) of any configuration. Control device 16 and check valve 18 would be connected to this collector, as in the illustrated embodiment for gravity conduit 14 of backwater tank 10.

In this exemplary embodiment, backwater tank 10 is round, and is divided into a main chamber 22 and an auxiliary chamber 24 by a vertical partition 20, whose pronounced curvature is shown in FIG. 2. Only main chamber 22 is connected with gravity conduit 14 through connection 12. Auxiliary chamber 24 houses check valve 18, and control device 16, in addition to the conduit (not shown) connected between these two units. The respective connections 25 and 28 between check valve 18 and gravity conduit 14, and control device 16 and gravity conduit 14, extend with appropriate sealing through the floor of tank 10. Vacuum conduit 30 which connects check valve 18 with the vacuum drainage conduit passes through the side wall of tank 10 to the outside. As shown in FIG. 2, connections 12, 26 and 28 are aligned with gravity conduit 14. These connections can be fixedly connected at their lower ends so that the whole unit, consisting of tank 10, control device 16 and check valve 18, can then be connected to the gravity conduit of the house or building at the building site with only a single pressureless connection, and with a single vacuum connection to the vacuum drain conduit.

To protect the vacuum drain system, the narrowest portion 32 of conduit 14 is disposed directly adjacent to the relatively large connection 12 to tank 10. For this reason, from this location outwardly, clogging can be eliminated without difficulty. For the same purpose, as illustrated in FIG. 4, it is advantageously provided that a narrow portion 32 of connection 26 for check valve 18 will be aligned with connection 12 of tank 10.

Control device 16 is also connected inside auxiliary chamber 24 through a control conduit (not shown) to vacuum conduit 30. Accordingly, there is no need for any other external connections from tank 10 to an energy source.

In the region of main chamber 22, openings 40 are provided in the upper portion of the side wall of tank 10 which have a triple function. Specifically, openings 40 provide ventilation, overflow protection, and noise damping. To this end, openings 40 are composed of a pair of T-shaped pieces of pipe connected with each other in an orthogonal (crossed) arrangement, as illustrated. Advantageously, one pipe piece, located on the inside of the tank and denoted 36, extends vertically whereas, on the outside of tank 10, a further pipe piece 34 assumes an essentially horizontal position (see FIG. 3). The two T-shaped pipe pieces 34 and 36 shown in FIG. 3 can be connected with each other, and with tank 10, by bonding them onto a short pipe piece 38 which extends through a hole in the tank wall, as illustrated in FIG. 3.

The embodiment according to FIG. 4 has the particular advantage that, becbuse of the aligned disposition of conduit section 32 with respect to connection 12 and because of the essentially right-angle arrangement of conduit section 32 relative to gravity conduit 14, the air sucked in after each opening of check valve 18 will flow principally through connection 12 and tank 10, and only a minor part thereof will flow through gravity conduit 14. In this way disturbing noises which would occur in the conduits in the house which are connected to the gravity conduit 14 will be prevented.

Although the invention has been described relative to examplary embodiments thereof, it will be understood that other variations and modifications can be effected in these embodiments without departing from the scope and spirit of the invention.

I claim:

1. In a backwater tank for building connected to a vacuum drain facility, wherein the waste water of the building is transported through gravity conduits into a collector which is connected to a vacuum drain conduit, by means of a check valve that opens automatically at a predetermined maximum water level under the control of a pneumatic control device, and wherein a ventilated backwater tank is connected to the gravity conduit or the collector at a level above the maximum water level in the collector, the backwater tank having a main chamber and being large in comparison to the collector, the improvement wherein at least one of (i) the check valve and (ii) the pneumatic control device, is disposed in the tank, outside the main chamber thereof.

2. A backwater tank as claimed in claim 1, wherein the check valve and the pneumatic control device are both disposed in a common auxiliary chamber in the backwater tank.

3. A backwater tank as claimed in claim 1 or 2, wherein the connections of the pneumatic control device, the tank, and the check valve which are to be connected to the gravity conduit of the building extend downwardly out of the tank and are disposed vertically and in a straight line alignment in a vertical plane.

4. A backwater tank as claimed in claim 3, wherein the connections of the pneumatic control device, the tank and the check valve are connected with each other in a pre-assembled unit, by a connector member which is adapted to be connected to the gravity conduit of the building.

5. A backwater tank as claimed in claim 1, wherein a central connection is provided in a floor of said tank, said floor sloping downwardly toward said central connection, said tank including connections from the gravity conduit to the pneumatic control device and to the check valve which are diametrically opposed, with reference to the central connection of the tank.

6. A backwater tank as claimed in claim 1 wherein a connecting pipe between the connection from the tank to the gravity conduit and the connection from the check valve to the gravity conduit includes a narrow portion the cross section of which, and the vertical projection of the longitudinal axis of which, lies within the cross section of the connection opening of tank.

7. A backwater tank as claimed in claim 2 wherein a partition is provided between the main chamber and the auxiliary chamber of tank, said partition extending vertically with reference to a connecting line defined between the connections of the pneumatic control device, the tank and the check valve and being curved so as to extend to a point near the side wall of the backwater tank.

8. A backwater tank as claimed in claim 1 wherein said tank is closed by a cover, and is provided at the upper edge thereof with means defining at least one ventilation and overflow opening.

9. A backwater tank as claimed in claim 8 wherein said means defining at least one ventilation and overflow opening comprises a pair of short pipe sections disposed orthogonally to one another.

10. A backwater tank as claimed in claim 9 wherein said pipe sections are T-sections.

* * * * *